United States Patent [19]

Uden et al.

[11] Patent Number: 4,731,963

[45] Date of Patent: Mar. 22, 1988

[54] VERGE UNIT WITH FRANGIBLE FEATURE

[75] Inventors: Michael A. Uden, Copthorne; Mark L. Hesketh, Ourley, both of United Kingdom

[73] Assignee: Redland Roof Tiles Limited, Surrey, United Kingdom

[21] Appl. No.: 927,994

[22] Filed: Nov. 7, 1986

[30] Foreign Application Priority Data

Jul. 11, 1985 [GB] United Kingdom ..... 8527475

[51] Int. Cl.[4] ..... E04D 13/15

[52] U.S. Cl. ..... 52/94; 52/98

[58] Field of Search ..... 52/98, 99, 100, 94, 52/95, 556, 277

[56] References Cited

U.S. PATENT DOCUMENTS 4,233,786 11/1980 Hildreth ..... 52/556

4,442,641 4/1984 Quinnell ..... 52/277

*Primary Examiner*—John E. Murtagh

*Attorney, Agent, or Firm*—Beveridge, DeGrandi & Weilacher

[57] ABSTRACT

Verge unit is a symmetrical tapered channel converging toward one end and diverging toward another end. The unit 1 has two frangible portions which are disposed inwardly at the divergent end the removal of one of which portions allows the unit to be converted into a right hand or a left hand unit for use on a right hand or left hand verge of a roof. The units are placed over the free ends of tiles on a verge so that each divergent end of a unit is overlapped by a convergent end of an adjacent unit, thus providing a stepped line following the line of overlapping tiles along the upper edge of the verge and a straight line running along the lower edge. Verge units may be used for covering the free ends of tiles on tiled roofs to provide an aesthetically pleasing finish to the verge ends of tiled roofs and to prevent the ingress of rain and snow between the tiles.

9 Claims, 7 Drawing Figures

VERGE UNIT WITH FRANGIBLE FEATURE

This invention relates to improvements to verge units for tiled roofs.

Verge units are provided at the verge ends of tiled roofs to enclose the free ends of tiles or similar elements with which the roof is covered. Usually such verge units, which are often made from plastics materials or the like, are of interlocking box-like construction, and the aim of using such units is to provide an aesthetically pleasing finish to the tile ends, with a stepped line following the line of overlapping tiles along the upper edge of the verge and a straight line running along the lower edge.

One of the major problems relating to verge units is that hitherto, it has been usual to provide right or left handed units for fitting to the respective verge ends. Examples of such systems are given in PCT Specification No. WO 81/01583 and U.K. Patent Specification No. 2152967A. However, with these systems the tiler must ensure that the correct handed unit is obtained and fitted at each end. The cost of such units and stocking requirements are thus higher than if a single unit could be used at both ends.

An alternative system, such as that given in U.K. Specification No. 2014639 attempts to overcome these problems by using a symmetrical unit which may be used at either verge end. Further problems lie in the necessarily exposed ends of the tiles where two adjacent units interlock. This detracts from the pleasing finish which the units aim to create and could also lead to gaps allowing water to enter the system. Often such symmetrical units also require extra cladding strips to be fitted.

In order to accommodate the manifold tile configurations some verge units can be very complex, thereby presenting difficulties to the moulders during manufacture and to the tilers during the fixing thereof.

Thus it is the object of the present invention to reduce or overcome these disadvantages by providing a simplified verge unit, which is manufactured as a symmetrical unit, and is capable of easy conversion into a right or left handed unit by the tiler before fitting.

According to the present invention there is provided a verge unit, being a tapered channel element symmetrical about its longitudinal axis prior to use, comprising a side, upper and lower wall converging toward one end, and at the divergent end are two inwardly disposed frangible portions, the removal of one of which provides the capability of converting the verge unit for use on a left or right hand verge.

Preferably the verge unit comprises a roof batten end housing which is supported by the side wall of the channel element.

Preferably the roof batten end housing is a U-shaped housing, which is symmetrical about the longitudinal axis of the unit, the back wall of which is a part of the channel element side wall and positioned to allow the housing to slide over a roof batten end.

Preferably the verge unit assembly is secured in position by a U-shaped clip, which is inserted through a combination of slots and apertures symmetrically positioned in the batten end housing and channel element side wall and is adapted to be secured to the roof batten by a plurality of screws or similar fasteners.

The verge unit may have an inwardly stepped portion at the convergent end, which may have a complementary groove and rib arrangement between the frangible portion and the stepped portion.

The verge unit is preferably made from a mouldable plastics material.

The preferred arrangement is a tiled roof having a plurality of overlapping tiles supported by roof battens, and a plurality of overlapping verge units covering the end tiles, with the lower frangible portions of each unit broken out of the previous verge units and the remaining portions resting on the upper walls of the previous verge units such that adjacent units are interconnected, and with the ends of the roof battens positioned inside their housings, the verge unit being secured with clips and fasteners to the battens.

A preferred embodiment of the invention will now be described in detail with reference to the accompanying drawings in which.

Verge units are in the main designed for attachment to one end of a roof structure. Only with plain cladding strips or simple channel elements of uniform or tapered configuration has to be possible to utilise a similar unit at each end of a roof.

The new generation of verge units for effecting a dry fitting are designed to be aesthetically pleasing when fixed to a roof structure and are of such configuration that they appear to continue the line of tiles over the edge of a roof at the verges thereof.

The verge unit described below is one such unit; however, by incorporating into a verge unit, having a line of symmetry, frangible break-out portions, it has become possible to utilise the one unit at either end of a roof merely by removing one or other of the break-out portions.

The units to be described hereinafter are those suitable for use at a right hand end of a roof.

Figure 5:
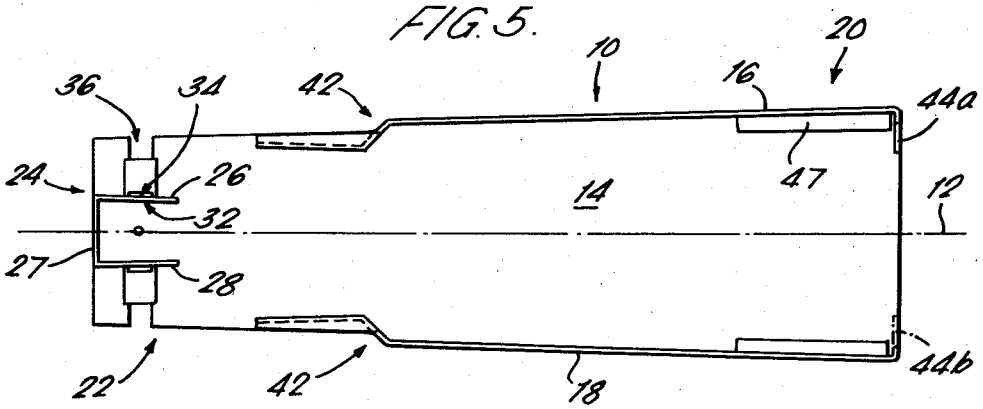
FIG. 5 is a side view of a verge unit.
Figure 6:
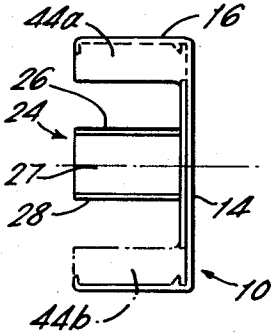

The verge unit, thus, comprises a tapered channel 10 of moulded plastics material, which channel has a line of symmetry 12 indicated in chain-dot line in FIGS. 5 and 6.

The channel 10 comprises a main side wall 14, an upper wall 16 and a lower wall 18 which converge towards each other along the length of the unit whereby, in use, a widest end portion 20 of one unit accommodates a reduced end portion 22 of a next in line unit down the roof, as shown in FIGS. 1, 2, 3 and 4.

The wall 14 of the unit extends beyond the walls 16 and 18 and at its reduced end portion 22 provides support for a roof batten end housing 24.

The housing 24 comprises upper and lower wall portions 26 and 28 respectively which extend inwardly from the wall 14 and are equi-spaced one on either side of the line of symmetry 12. The housing 24 also comprises a third wall 27 which extends from an end of the wall 14 to adjoin the portions 26 and 28 to form a U-shaped housing the purpose of which will be made clear hereinafter.

Figure 3:
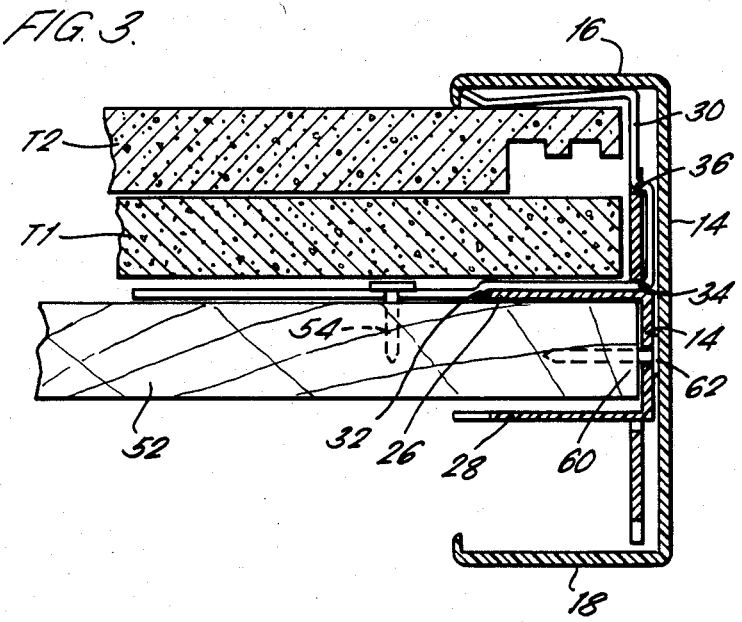
FIG. 3 is a part section view taken along the line III—III of FIG. 1.

A combination of slots and apertures in the wall 144 and wall portions 26 and 28 enables the insertion of essentially U-shaped clips 30, which, as shown in FIG. 3 firmly clamps the unit to the roof when the tiles are inserted into the unit.

Thus, the wall portion 26 comprises an open ended slot 32 on its end remote from the wall 14 and the wall 14 comprises an aperture 34 adjacent the joint between the wall portion 26 and the wall 14 and an open ended slot 36 in its upper edge 38 thereof the slots 32 and 36 and the aperture 34 being arranged to accommodate clips 30.

Figure 1:
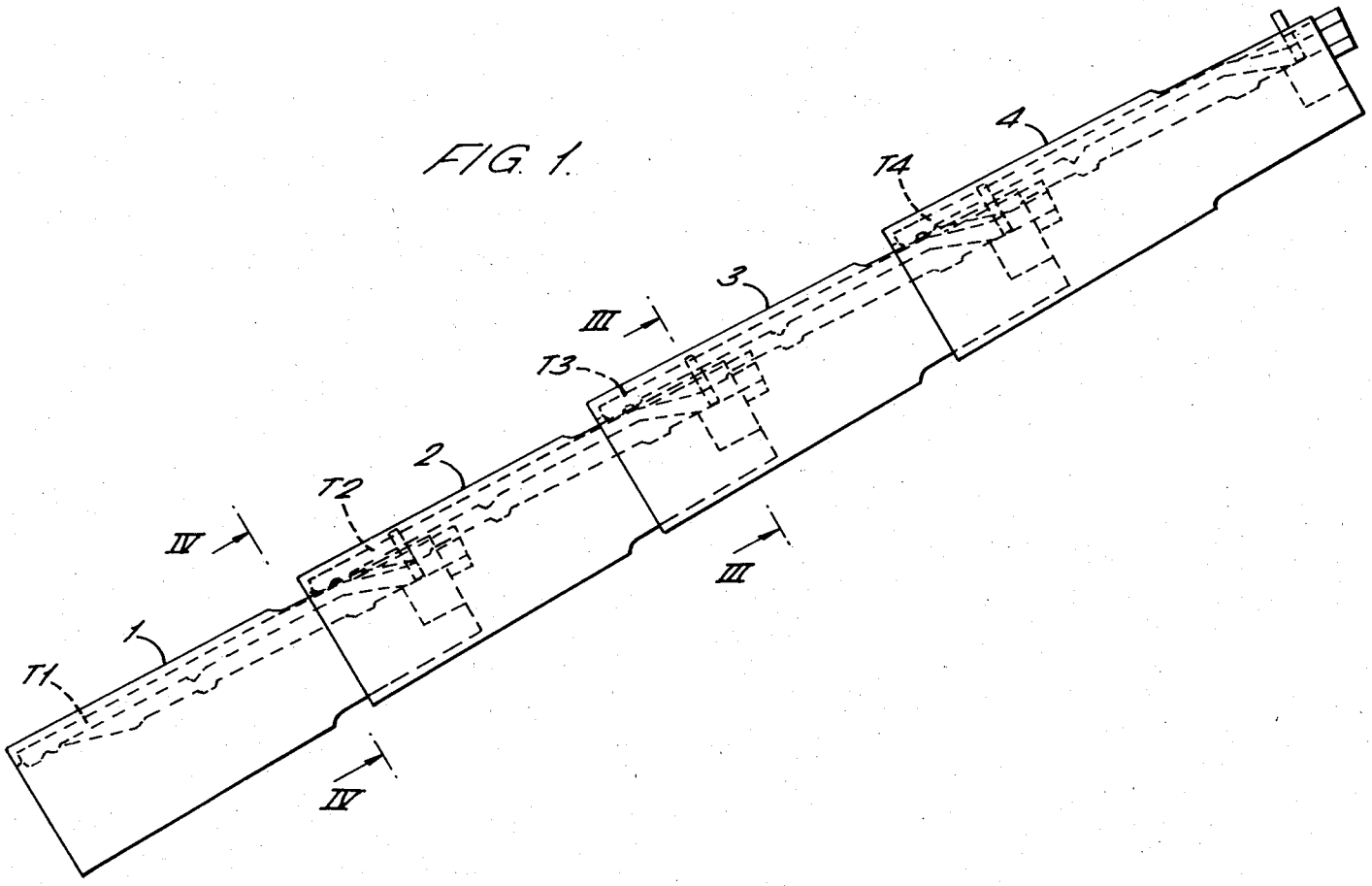
FIG. 1 is a schematic side elevation of verge units at a right hand end of a pitched roof covered with concrete roof tiles.
Figure 2:
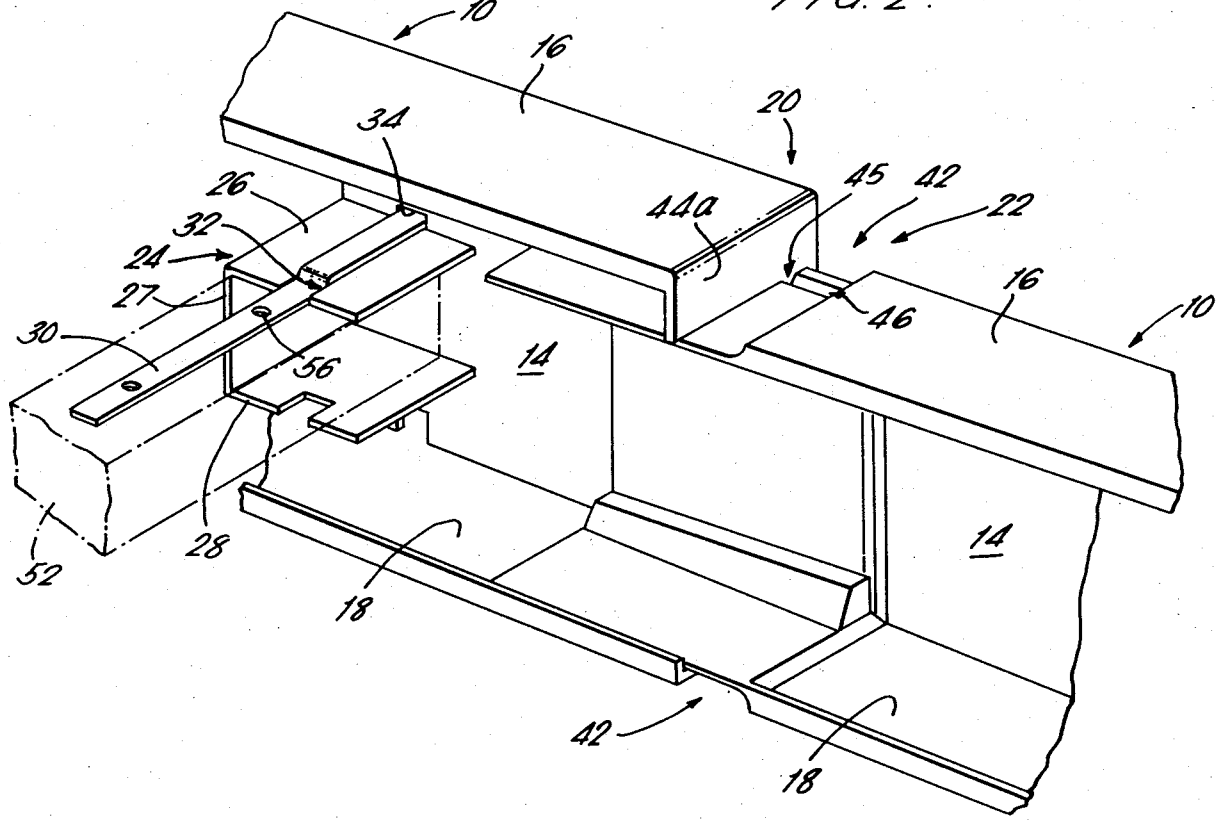
FIG. 2 is a perspective view showing two verge units located at a right hand end of a roof with a tile batten associated therewith shown in chain-dot lines.

The verge unit is further provided with a stepped feature 42 part way along its length whereby the accommodation of the reduced portion 22 of one unit is further facilitated within the end portion 20 of a next in line unit up the roof as shown in FIGS. 1 and 2.

Figure 4:
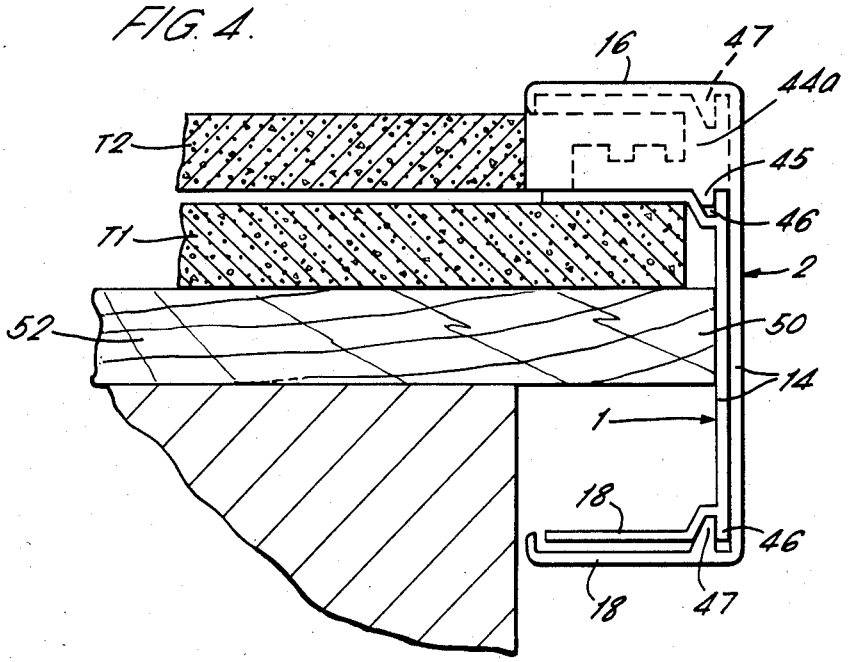
FIG. 4 is a part section view taken along the line IV—IV of FIG. 1.
Figure 7:
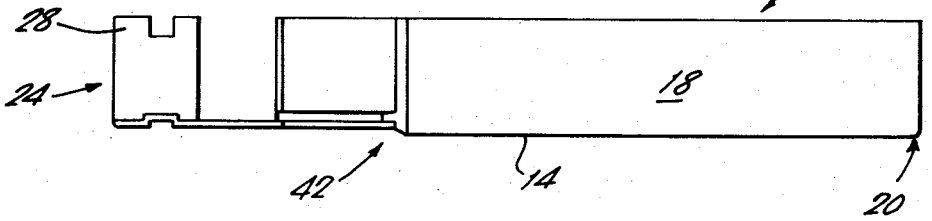
FIGS. 6 and 7 are first angle projections of the unit shown in FIG. 5.

As its end portion 20 the verge unit also comprises frangible break-out portions **44*a* and 44*b*, see FIGS. 4, 5 and 6, the portion 44*a* being shown in full line and the portion 44*b***, which has been removed for the purpose to be described, is shown in chain-dotted line.

The frangible break-out portion **44*a* comprises a key portion 45 adapted to slide into a slot 46 of similar cross-section formed in the wall 16 of a next in line units down a roof, see FIGS. 2 and 4. Likewise, the portion 44*b* and wall 18** have similar features.

To complement the key portions 45, the underside of the wall 16 and the upper side of the wall 18 viewing the drawings provided herewith, and especially FIGS. 2 and 4, are provided with key portions 47. Thus, when units 1 and 2 are assembled, as shown in FIGS. 2 and 4, the key portion 47 on the wall 18 are accommodated in an associated slot to effectively secure the units together.

When tiling a roof and closing the verges of the roof utilising the units a tiler prepares verge units for use at each end of the roof by breaking out the appropriate portions **44*a* and 44*b* and assembling clips 30 as shown in FIG. 3 for the right hand verge of the roof. Verge units for use at the left hand verge will have clips 30 assembled in the slots and apertures associated with the wall portion 38**.

The tiler then closes the right hand verge using the units shown in the FIGS. 1, 2, 3 and 4 by:

(a) placing a first unit 1 at the lower edge of the verge with its housing 24 located about the end 50 of a batten 52;

(b) securing the unit to the batten 52 by a fastener 54 which passes through an aperture 56 provided in the clip 30;

(c) sliding a verge tile T1 under unit 1 and locating it on the batten 52 as shown in FIG. 1;

(d) placing a second unit 2 to partially overlie the reduced end portion of the unit 1 which the housing 24 of the unit 2 located about the end 50 of a next in line batten 52 and moving the end 20 of the unit 2 into mutual engagement with the unit 1 as shown in FIGS. 2 and 4;

(e) securing unit 2 to the next in line batten by a fastener 54; and, (f) repeating steps c, d and e with tiles T3 and T4 etc. and units 3 and 4 etc., until the verge is finished.

The tiler then repeats the procedure at the opposite end of the roof utilising the same general configuration of verge unit but with the portions **44*b*** broken out as aforesaid.

The units also comprise an aperture 60 on their line of symmetry through which a further fastener 62 may be nailed into the end 50 of the batten 52 to give added security to the fixing thereof.

As can be seen in FIGS. 1 and 2 the units present an aesthetically pleasing appearance to the verge end of a roof with the portions **44*a* (and 44*b* not shown) closing the gap between the upper walls 16** of successive units, completely enclosing the tile ends following the stepped line of the tiled roof at the upper edge and a straight line along the lower edge. This also increases the protection against water entering the system.

It will readily be appreciated that having a symmetrical unit which can be converted into a right or left handed unit simplifies the manufacture of verge units, the stocking requirements of builders merchants, and simplifies the process of fitting the units for the tiler.

What is claimed is:

1. A verge unit, being a tapered channel element converging toward one end and comprising a side, upper and lower wall symmetrical about the longitudinal axis of the unit prior to use, and a pair of inwardly disposed break-out portions at a divergent end of the verge unit, wherein one of said break out portions must be removed before the unit is used to convert the symmetrical unit into a right hand verge unit, or the other of the pair of break-out portions removed to convert the symmetrical unit into a left hand verge unit.

2. A verge unit as claimed in claim 1 further comprising a roof batten end housing supported by the side wall of the channel element.

3. A verge unit as claimed in claim 2 in which the roof batten end housing is a U-shaped housing, which is symmetrical about the longitudinal axis of the unit, the back wall of which is a part of the channel element side wall and positioned to allow the housing to slide over a roof batten end.

4. A verge unit as claimed in claim 3 which is secured in position by a U-shaped clip, which is inserted through a combination of slots and apertures symmetrically positioned in the batten end housing and channel element side wall, and is adapted be secured to the roof batten by a plurality of fasteners.

5. A verge unit as claimed in claim 1 in which there is an inwardly stepped portion at the convergent end.

6. A verge unit as claimed in claim 5 in which there is a complementary groove and rib arrangement between the break-out portions and the stepped portion.

7. A verge unit as claimed in claim 1 made from a mouldable plastics material or the like.

8. A tiled roof having a plurality of overlapping tiles supported by roof battens, and a plurality of overlapping verge units, as claimed in claim 1, covering the end tiles, with the lower break-out portions of each unit broken out, and the remaining portions resting on the upper walls of the previous verge units such that adjacent units are interconnected, and with the ends of the roof battens positioned inside the U-shaped housings, the verge unit being secured with clips and fasteners to the battens.

9. A verge unit, being a tapered channel element symmetrical about its longitudinal axis prior to use, comprising a side, upper and lower wall converging toward one end, said side wall comprising a back wall of a U-shaped roof batten end housing which also is symmetrical about the longitudinal axis of the unit, said housing positioned so that it slides over a roof batten end, and at the divergent end of the unit are two inwardly disposed break-out portions, the removal of one of which provides the capability of converting the verge unit for use on a left or right hand verge.

* * * * *